US006769964B2

(12) United States Patent
Tunstall

(10) Patent No.: US 6,769,964 B2
(45) Date of Patent: Aug. 3, 2004

(54) ABRASIVE TOOL HAVING A UNITARY ARBOR

(75) Inventor: John Tunstall, Buffalo Grove, IL (US)

(73) Assignee: Saint-Cobain Abrasives Technology Company, Worcester, MA (US)

( * ) Notice: Subject to any disclaimer, the term of this patent is extended or adjusted under 35 U.S.C. 154(b) by 55 days.

(21) Appl. No.: 10/211,708

(22) Filed: Aug. 2, 2002

(65) Prior Publication Data

US 2004/0023599 A1 Feb. 5, 2004

(51) Int. Cl.[7] ..... B24B 1/00
(52) U.S. Cl. ..... 451/44; 451/43; 451/285
(58) Field of Search ..... 451/44, 59, 43, 451/450, 541–547, 285–288

(56) References Cited

U.S. PATENT DOCUMENTS

| | | | | |
|---|---|---|---|---|
| 3,830,020 A | | 8/1974 | Gomi | |
| 4,408,367 A | | 10/1983 | Pusterhofer | |
| 4,457,113 A | * | 7/1984 | Miller | 451/541 |
| 4,621,464 A | | 11/1986 | Kelly | |
| 5,216,844 A | | 6/1993 | Tamburini et al. | |
| 5,662,515 A | * | 9/1997 | Evensen | 451/59 |
| 5,713,784 A | | 2/1998 | Miller | |
| 5,928,060 A | | 7/1999 | Miller | |
| 6,358,133 B1 | * | 3/2002 | Cesena et al. | 451/450 |

FOREIGN PATENT DOCUMENTS

| | | |
|---|---|---|
| DE | 3830202 | 3/1990 |
| EP | 0328107 | 8/1989 |

OTHER PUBLICATIONS

Tunstall, John, "Flat Glass Edging and Drilling", Glass, p. 530, Dec. 1996.
Benson, Jack L., "Flat Glass Profiling", p. 16–23, Oct. 1982.
Konig Maschinenbau, "'Brilliant' Acid–Free Holloware Processing", Glass, p. 24, Jan. 1991.

* cited by examiner

*Primary Examiner*—Lee D. Wilson
(74) *Attorney, Agent, or Firm*—Mary E. Porter; Sampson & Associates

(57) ABSTRACT

A grinding tool and method is provided for shaping an edge of sheet glass. The grinding tool includes an arbor and a wheel being of a unitary construction and including an axis of rotation. The grinding tool further includes a recess extending along a periphery of the wheel, with a bonded abrasive being disposed therein. The bonded abrasive is sized and shaped for being profiled, to shape an edge of a glass sheet upon rotation of the tool about the axis. The bonded abrasive may further be sized and shaped for being re-profiled after use. The grinding tool of this invention may provide for both improved quality and reduced cost sheet glass.

24 Claims, 4 Drawing Sheets

ABRASIVE TOOL HAVING A UNITARY ARBOR

BACKGROUND OF THE INVENTION (1) Field of the Invention

The present invention relates generally to grinding tools and more particularly to grinding tools for use in edge grinding of sheet glass. Use of the grinding wheel of this invention may improve glass quality and reduce process downtime.

(2) Background Information

The use of diamond containing abrasive wheels to contour and/or chamfer the edge of flat glass (also referred to herein as sheet glass), such as that used in the automotive, architectural, furniture, and appliance industries, is well known and is typically carried out for both safety and cosmetic reasons. The abrasive wheels of the prior art include a profiled, bonded abrasive matrix disposed in a recess at the periphery of the wheel (see U.S. Pat. No. 3,830,020 to Gomi and U.S. Pat. No. 4,457,113 to Miller). During an edge grinding operation, periodic reprofiling of the abrasive is typically required to produce consistent high quality glass. For optimum economic results it is typically desirable to minimize the downtime associated with reprofiling and to bring newly reprofiled wheels back on-line with minimal break-in and/or conditioning.

Therefore, there exists a need for a grinding tool and/or method for edge grinding of sheet glass that may provide for reduced downtime and/or improved grinding performance.

SUMMARY OF THE INVENTION

One aspect of the present invention includes a grinding tool for shaping an edge of a glass sheet. The grinding tool includes an arbor and a wheel, the arbor and wheel being of unitary construction and having a common axis of rotation. The grinding tool further includes a recess extending along a periphery of the wheel with a bonded abrasive disposed therein. The bonded abrasive is sized and shaped for being profiled, to shape an edge of a glass sheet upon rotation of the tool about the axis. In one variation of this aspect the bonded abrasive may be further sized and shaped for being re-profiled after use.

In another aspect, this invention includes a method for shaping an edge of a glass sheet. The method includes providing a grinding tool as described in the proceeding paragraph, rotating the grinding tool about the axis, and applying the bonded abrasive to the edge of the glass sheet. In one variation of this aspect, the method further includes reprofiling the bonded abrasive.

In still another aspect, this invention includes a method for profiling an abrasive matrix in a grinding tool. The method includes providing a grinding tool as described in the proceeding paragraph and machining a profile in an outer surface of the bonded abrasive matrix. In one variation of this aspect, the machining includes an electro discharge machining operation.

DETAILED DESCRIPTION

Figure 2A:
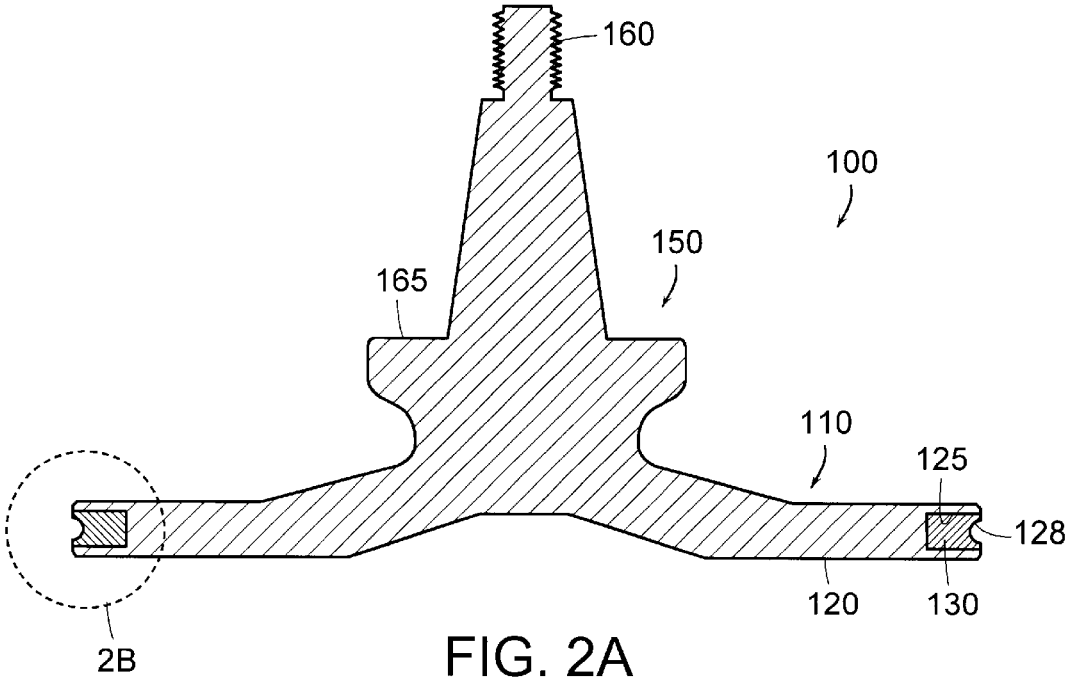
FIG. 2A is a cross sectional representation of one embodiment of a grinding tool according to the principles of the present invention.

Referring briefly to FIG. 2A, the present invention includes a grinding tool that may be useful in edge grinding a workpiece such as sheet glass for use in various applications, including automotive windows, architectural applications, furniture, and appliances. The grinding tool of this invention includes an arbor and an abrasive wheel having a unitary construction, i.e., an abrasive wheel in which the arbor is an integral part thereof. In one embodiment, grinding tool 100 typically includes a wheel portion 110 having a body 120 with a recess 125 extending circumferentially along a periphery thereof. A bonded abrasive 130, i.e., a plurality of abrasive grains disposed in a framework of bond material, is disposed in the recess 125. Grinding tool 100 further includes an arbor portion 150 integral with the wheel portion 110, i.e., integral with body 120. Arbor portion 150 may include a threaded end-portion 160 or other means for coupling to a conventional grinding machine (not shown).

The grinding tool of the present invention may advantageously provide for improved quality grinding, and in particular reduced edge chipping, during edge grinding of sheet glass. Embodiments of this invention may also provide economic advantages such as reduced downtime during reprofiling, reduced power consumption, and/or reduced capital requirements. These and other advantages of this invention will become evident in light of the following discussion of various embodiments thereof.

As used herein the term arbor refers to a device coupled to the spindle or axle of a machine, and to which a tool such as a cutting, grinding, or polishing wheel is mounted for imparting rotary motion thereto. A unitary arbor refers to an arbor that is an integral part of the tool, i.e., in which a grinding wheel and arbor are of a unitary construction. The term edge grinding refers to a grinding operation in which a work piece, such as sheet glass, is shaped (e.g., contoured and/or chamfered) by grinding the edge thereof.

Figure 1A:
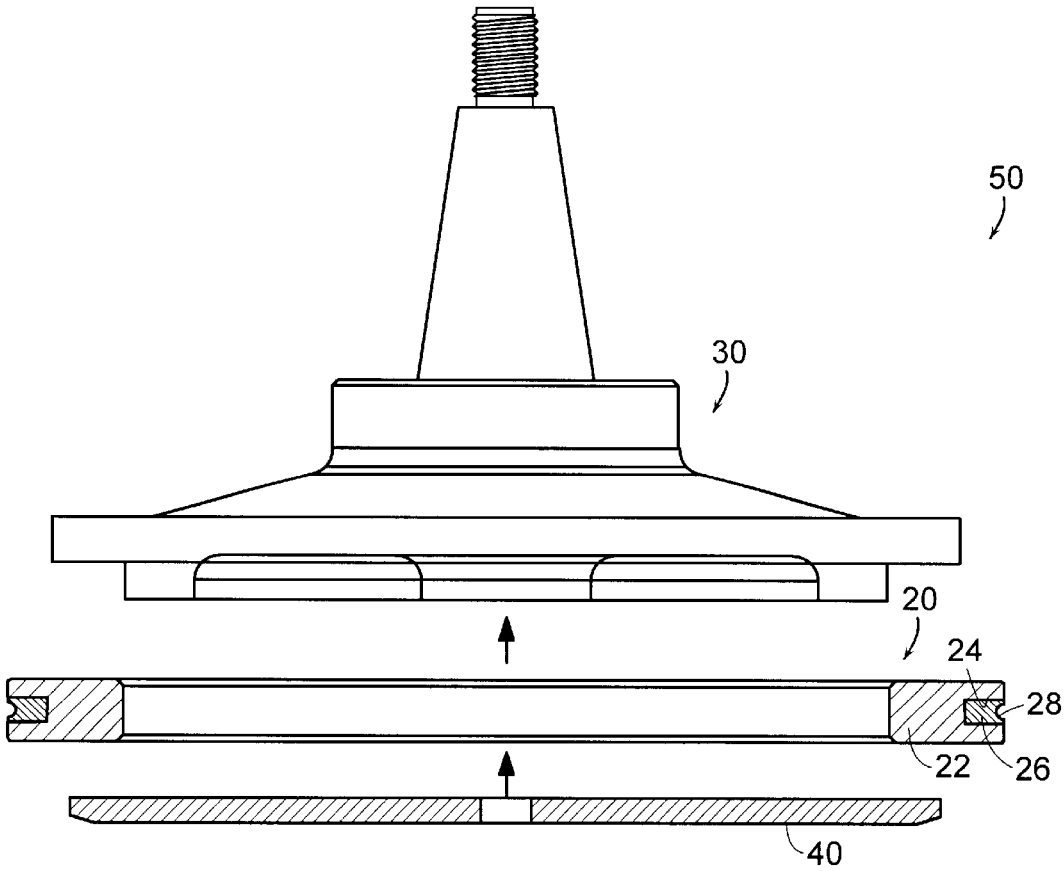
FIG. 1A PRIOR ART
FIG. 1A is a schematic representation of a prior art grinding wheel.
Figure 1B:
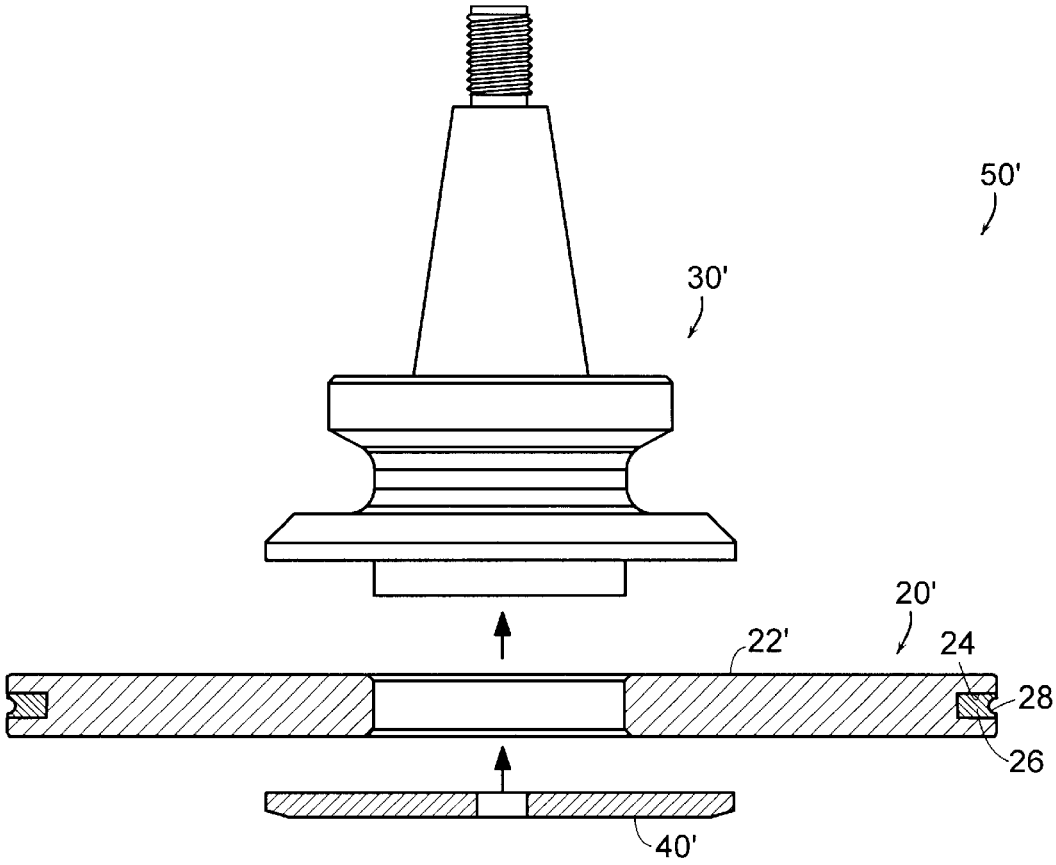
FIG. 1B PRIOR ART
FIG. 1B is a schematic representation of a prior art grinding wheel.

Referring now to FIGS. 1A–2, prior art and the apparatus and method of the present invention are described. FIGS. 1A and 1B, illustrate examples of conventional grinding tools 50, 50', which typically include a grinding wheel 20, 20' mountable (e.g., by bolting) on an arbor 30, 30'. The grinding wheel 20, 20' typically includes a bonded abrasive 26 disposed thereon. Grinding wheels 20, 20' typically include a flat, annular body portion 22, 22' the periphery of which is radially inwardly slotted, e.g., about the center plane, to provide an annular recess 24, which holds and acts as a support structure for the bonded abrasive 26. The bonded abrasive 26 typically includes a U or V shape profile 28 ground therein, which is reproduced on the glass. Wheels of this configuration are commonly referred to as 'pencil edging' grinding wheels due to their profile 28. Grinding wheel 20, 20' is typically mounted to arbor 30, 30' through the use of flange 40, 40', which serves to distribute operational stresses away from the central hole.

As described briefly hereinabove, grinding tool 50, 50' is typically used to shape sheet glass such as that used in automobiles, furniture, architecture, and appliances. The grinding wheel 20, 20' is dressed periodically, e.g., with an aluminum oxide abrasive stick to re-expose the abrasive grains and remove any impacted glass fines from the surface of the wheel. When the profile 28 has worn sufficiently to be out of tolerance, or to produce edge chipping (edge chipping is often observed when the profile 28 becomes attenuated), the wheel is removed and re-profiled by form grinding, e.g., with a silicon carbide wheel, or by electro discharge machining (EDM). During re-profiling, the wheel 20, 20' is typically removed from the arbor 30, 30'.

The effort and downtime associated with removing the wheel 20, 20' from the arbor 30, 30' for reprofiling purposes is undesirable. Furthermore, reengagement of the reprofiled wheel with the sheet glass often results in initial edge chipping of the glass. While this problem tends to be transient in nature, i.e., self-correcting with time, sheet glass having edge chips must typically be scrapped at considerable expense. This problem tends to be significant since a typical wheel 20, 20' may be reprofiled on average from about 8 to 10 or more times during its useful life.

One solution to the problem, in particular for applications requiring relatively high edge quality, has been to grind scrap glass for some period of time after reprofiling. This approach, while it may reduce scrap, tends to significantly increase downtime and reduce the service life of the wheel.

One aspect of this invention is the realization that the above-described edge-chipping problem may be related to run-out (e.g., an irregular or eccentric path of rotation by the grinding wheel) caused by imperfect concentricity between the arbor and the remounted wheel. Not wishing to be bound by a particular theory, it is believed that remounting the wheel to the arbor after reprofiling may result in slightly imperfect concentricity therebetween. As such the wheel operates essentially as though it has not been properly trued, i.e., rotating with a slight wobble. It is believed that this "wobble" causes the transient edge chipping problem until the bonded abrasive has been sufficiently worn.

One potential solution may be for the wheel to remain on the arbor during the reprofiling process. This approach, while it may eliminate the transient edge chipping problem observed after reprofiling, would tend to be disadvantageous in that it also significantly increases downtime (by idling a grinding machine during the reprofiling operation) or requires glass grinding operations to maintain a relatively large number of relatively expensive arbors and therefore may significantly increase capital costs and operating expenses.

Figure 2B:
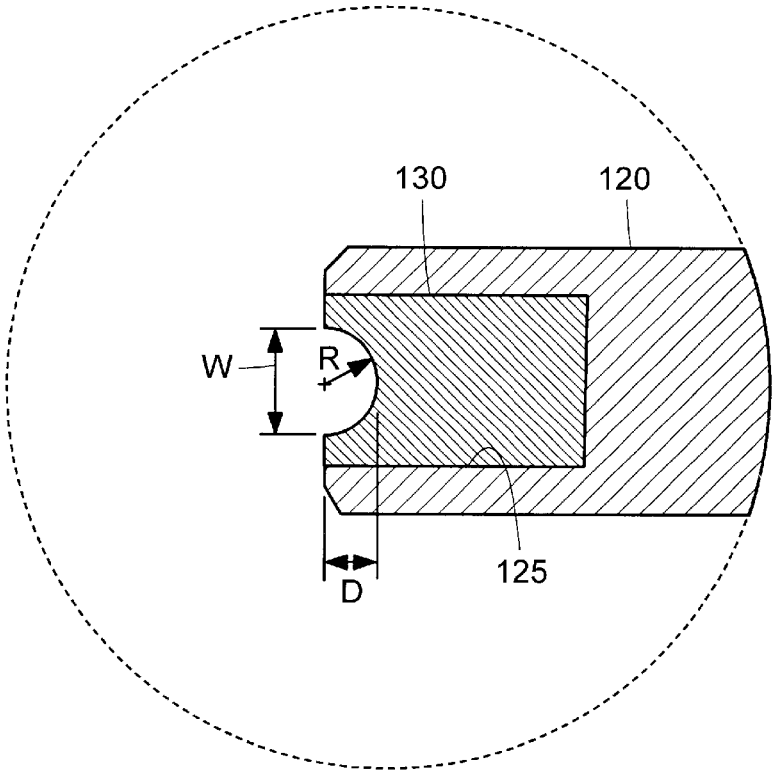
FIG. 2B is a cross sectional representation, on an enlarged scale, of a portion of the grinding tool of FIG. 2A.

Referring now to FIG. 2A, one embodiment of the grinding tool of the present invention is illustrated. As described hereinabove, grinding tool 100 typically includes a wheel portion 110 (i.e., a wheel means) having a body 120 with a recess 125 extending along a periphery thereof. A bonded abrasive 130 is disposed in the recess 125. Accordingly, bonded abrasive 130 functions as abrasive means and recess 125 functions as support means for the abrasive. The bonded abrasive 130 typically includes a profiled grinding surface 128. In general it is desirable to size and shape the bonded abrasive 130 to include sufficient depth in the radial direction to accommodate up to 10 or more reprofiling steps during the life of the grinding tool. The profile 128 is typically U, V or basket shaped but may include substantially any shape, including those necessary to provide beveled, chamfered, Ogee, flat, arris, and the like edge patterns on sheet glass. A typical profile 128 varies depending on the glass thickness being ground and may typically be defined by a width (W), depth (D), and radius of curvature (R), as shown in FIG. 2B. One standard profile that tends to provide a relatively long life and satisfactory edge quality is defined as follows:

$$W = 2\sqrt{D(2R - D)}$$

wherein width (W) equals the glass thickness plus 0.5 millimeters and the minimum radius of curvature (R) is approximately equal to the glass thickness divided by two.

Figure 3A:
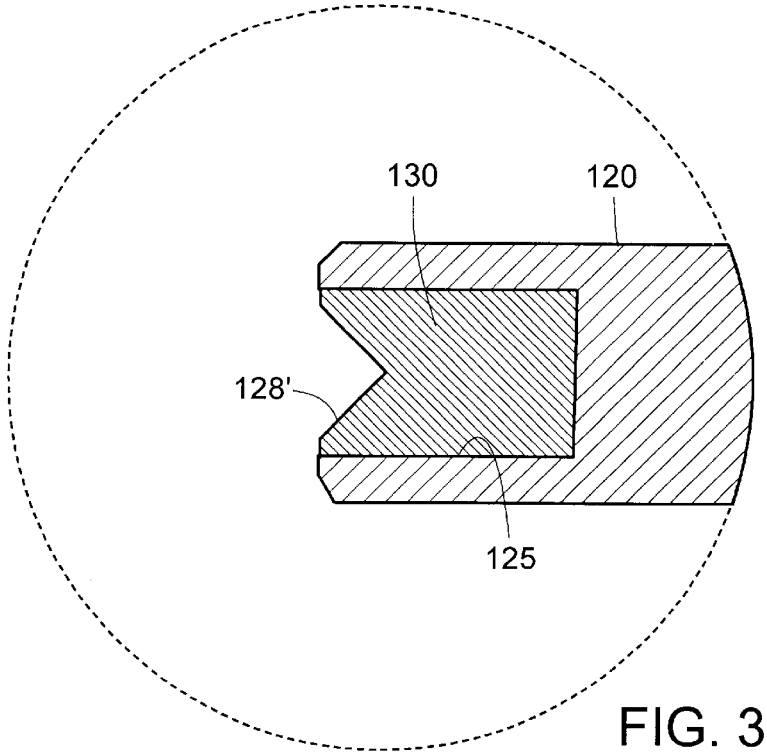
FIG. 3A is a view similar to that of FIG. 2B, of another embodiment of a grinding tool of this invention.
Figure 3B:
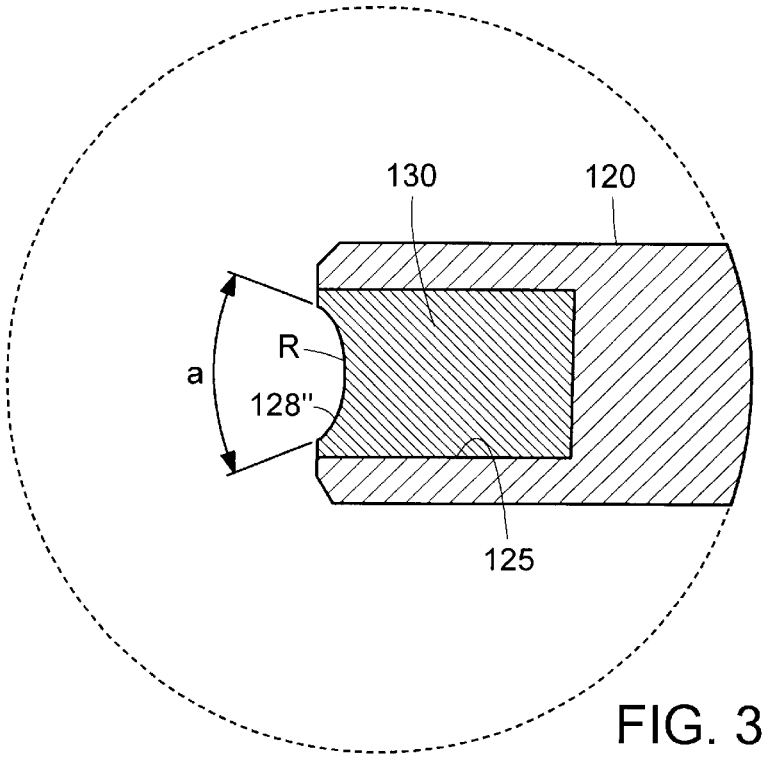
FIG. 3B is a view similar to that of FIGS. 2B and 3A, of still another embodiment of a grinding tool of this invention.

For many applications a better surface finish may be achieved using a basket profile in which:

$$W/2 = R\,\mathrm{Cos}(a/2) - (R-D)\mathrm{Tan}(a/2)$$

wherein a is the included angle (between the frusto-conical edges of the basket) and typically ranges from about 50 to about 60 degrees. R is the radius of curvature of the bottom of the basket. V-shaped 128' and basket shaped 128" profiles are shown in FIGS. 3A and 3B, respectively.

Grinding tool 100 further includes an arbor portion 150 integral with the wheel portion 110, i.e., integral with body 120. Accordingly, arbor portion 150 functions as arbor means for imparting rotary motion from a grinding machine to the wheel portion. Arbor portion 150 may include a threaded end-portion 160 or other means for coupling to a grinding machine. The arbor portion 150 and wheel portion 110 may be fabricated from substantially any material, e.g., an iron alloy such as tool steel, but are typically fabricated from a relatively lightweight material such as, but not limited to aluminum alloys and magnesium alloys. A relatively lightweight tool may advantageously reduce power consumption during use and result in less wear on drive spindles and other grinding machine components. A lightweight tool also tends to be relatively easy to mount and dismount from the grinding machine. A grinding tool including an aluminum body with a hardened steel insert at the mating face 165 between the grinding tool and the grinding machine may also be desirable in that it provides for a light-weight grinding tool having a highly wear resistant arbor portion 150.

Moreover, fabrication of these embodiments themselves may lead to cost savings relative to the prior art. For example, the mutually engaging surfaces of both conventional arbors 30,30' and grinding wheels 20, 20', should be manufactured to precise tolerances to help ensure that the mounted wheel runs true (i.e., concentrically) with the arbor. By fabricating the arbor and wheel in a unitary fashion, embodiments of the present invention eliminate the need for these close-tolerance fabrication steps, for potential associated cost savings.

Additional manufacturing cost savings may be realized due to potentially less demanding design parameters associated with embodiments of this invention. A single conventional arbor 30, 30', is often used with tens, if not hundreds, of grinding wheels. Accordingly, such arbors are constructed robustly, to withstand the stresses and wear and tear associated with this long useful life. Contrariwise, the unitary construction of the present invention dictates that the arbor portion 150 is discarded along with the wheel portion 110, upon depletion of the abrasive matrix, for a shorter useful life. As such, it may be possible to fabricate these embodiments using less costly materials and/or construction techniques, without adversely affecting safety. Alternatively, the arbor and wheel portions (150 & 110) may be recycled by inserting new bonded abrasive 130 into the wheel recess 125.

Grinding tool 100 may be substantially any size depending on the size and shape of the glass being ground. For typical applications, grinding tool 100 includes a wheel portion 110 having a diameter ranging from about 75 to about 250 millimeters.

The bonded abrasive 130 may include substantially any abrasive grain material. Conventional abrasives may include, but are not limited to, alumina, cerium oxide, silica, silicon carbide, zirconia-alumina, garnet, and emery in grit sizes ranging from about 0.5 to about 5000 microns, preferably from about 2 to about 300 microns, and most preferably from about 20 to about 200 microns. Superabrasive grains, including but not limited to diamond and cubic boron nitride (CBN), having substantially similar grit sizes as the conventional grains, may also be used. For most glass shaping applications diamond superabrasive grain is preferred. Edge quality tends to be determined by the diamond grain particle size. Increasing diamond grain particle size tends to increase grinding speed and wheel life at the expense of edge quality, while decreasing diamond grain size tends to improve edge quality at the expense of grinding speed and wheel life. One common superabrasive used for pencil edging automotive glass, includes a particle size distribution ranging from about 74 to about 88 microns (i.e., including superabrasive grains finer than U.S. Mesh (Standard Sieve) 170 and coarser than U.S. Mesh 200). For chamfering, a common superabrasive abrasive includes a particle size distribution ranging from about 63 to about 74 microns (i.e., finer than U.S. Mesh 200 and coarser than U.S. Mesh 230). Architectural glass typically requires a finer finish than automotive glass and may be ground with two tools, e.g., a coarse tool having a superabrasive particle size ranging from about 125 to about 149 microns (i.e., finer than U.S. Mesh 120 and coarser than U.S. Mesh 100) followed by a fine tool having a superabrasive particle size ranging from about 44 to 53 microns (i.e., finer than U.S. Mesh 325 and coarser than U.S. Mesh 270). Superabrasive concentration within the bond matrix may vary relatively widely, but typically is in the range from about 8 to about 13 volume percent for contouring applications and about 12 to about 25 volume percent for chamfering applications. Increasing superabrasive concentration tends to increase wheel life and decrease grinding speed.

Substantially any type of bond material commonly used in the fabrication of bonded abrasives may be used in the grinding tool of this invention. For example, metallic, organic, resinous, or vitrified bond (together with appropriate curing agents if necessary) may be used, with metallic bond being generally desirable. Materials useful in a metal bond matrix include, but are not limited to, bronze, copper, and zinc alloys (e.g., brass), cobalt, iron, nickel, silver, aluminum, indium, antimony, titanium, tungsten, zirconium, and their alloys, and mixtures thereof. Bronze alloys with low-level additions of cobalt, iron, and/or tungsten are generally desirably for most glass edging applications. Softer, less wear-resistant bonds are typically used for furniture, architecture, or appliance glass and are generally made using relatively low levels of cobalt, iron, and/or tungsten. Increasing cobalt, iron, and/or tungsten at the expense of bronze tends to increase wear resistance. Automotive glass grinding applications typically utilize highly wear resistant bonds having relatively high levels of cobalt, iron, and/or tungsten since long life is preferred, to minimize wheel changes on fully automated lines and hence reduce costly downtime.

The grinding tool of this invention may be used with substantially any conventional grinding machine, such as those provided by BYSTRONIC® Machinen Corporation (Switzerland), BANDO® Chemical Industries Corporation (Japan), or Glassline Corporation (Perrysburg, Ohio). During a typical grinding operation, glass is ground at rate ranging from about 2 to about 30 meters per minute. The profiled abrasive matrix may be dressed periodically using an implement such as an aluminum oxide abrasive stick in order to maintain the grinding speed and edge quality. The abrasive matrix may also be reprofiled using conventional means, such as by form grinding with a silicon carbide wheel or by electro discharge machining.

The modifications to the various aspects of the present invention described hereinabove are merely exemplary. It is understood that other modifications to the illustrative embodiments will readily occur to persons with ordinary skill in the art. All such modifications and variations are deemed to be within the scope and spirit of the present invention as defined by the accompanying claims.

What is claimed is:

1. A grinding tool for shaping an edge of a glass sheet, said tool comprising:

an arbor;

a wheel;

said arbor and said wheel being of unitary construction, and having an axis of rotation;

a recess extending along a periphery of said wheel;

a bonded abrasive disposed in said recess;

said bonded abrasive sized and shaped for being profiled, to shape an edge of a glass sheet upon rotation of said tool about the axis.

2. The grinding tool of claim 1 wherein said bonded abrasive is sized and shaped for being re-profiled after use.

3. The grinding tool of claim 1, the arbor and wheel being fabricated from a material selected from the group consisting of aluminum alloys and magnesium alloys.

4. The grinding tool of claim 1, the arbor and wheel being fabricated from an iron alloy.

5. The grinding tool of claim 1 wherein said bonded abrasive comprises a superabrasive grain selected from the group consisting of diamond and cubic boron nitride held in a matrix.

6. The grinding tool of claim 5 wherein said superabrasive grain comprises diamond.

7. The grinding tool of claim 5 wherein said superabrasive grain comprises a particle size distribution ranging from:

greater than or equal to about 2 microns; and less than or equal to about 300 microns.

8. The grinding tool of claim 5 wherein said superabrasive grain comprises a particle size distribution ranging from:

greater than or equal to about 20 microns; and less than or equal to about 200 microns.

9. The grinding tool of claim 5 wherein said bonded abrasive matrix comprises from:

greater than or equal to about 8 volume percent superabrasive grain; and less than or equal to about 25 volume percent superabrasive grain.

10. The grinding tool of claim 5 wherein said superabrasive grain is disposed in a metal bond matrix.

11. The grinding tool of claim 10 wherein said metal bond comprises a bronze alloy.

12. The grinding tool of claim 10 wherein said metal bond comprises a bonze alloy and a material selected from the group consisting of cobalt, iron, and tungsten.

13. The grinding tool of claim 1 wherein said bonded abrasive matrix comprises a profiled surface at the periphery thereof.

14. The grinding tool of claim 13 wherein said profiled surface comprises a shape selected from the group consisting of U-shaped, V-shaped, and basket shaped.

15. The grinding tool of claim 1 wherein said wheel comprises a diameter ranging from:

greater than or equal to about 75 millimeters; and less than or equal to about 250 millimeters.

16. A grinding tool for shaping an edge of a glass sheet, said tool comprising:

arbor means;

wheel means;

said arbor means and said wheel means being of unitary construction, and having an axis of rotation;

support means extending along a periphery of said wheel means;

abrasive means disposed in said support means;

said abrasive means sized and shaped for being profiled, to shape an edge of a glass sheet upon rotation of said tool about the axis.

17. A method for shaping an edge of a glass sheet, said method comprising:

mounting on a grinding machine, a grinding tool including:

an arbor;

a wheel;

the arbor and wheel being of unitary construction, and having an axis of rotation;

a recess extending along a periphery of the wheel;

a bonded abrasive disposed in the recess;

the bonded abrasive sized and shaped for being profiled, to shape an edge of a glass sheet upon rotation of said tool about the axis;

rotating the grinding tool about the axis; and applying the edge of the glass sheet to the bonded abrasive.

18. The method of claim 17 further comprising reprofiling the bonded abrasive.

19. The method of claim 18 wherein the grinding tool remains on the grinding machine during said reprofiling.

20. The method of claim 18 wherein said reprofiling comprises form grinding.

21. The method of claim 18 wherein said reprofiling comprises electro discharge machining.

22. A method for profiling a bonded abrasive in a grinding tool, said method comprising:

providing a grinding tool including:

an arbor;

a wheel;

the arbor and wheel being of unitary construction, and having an axis of rotation;

a recess extending along a periphery of the wheel;

a bonded abrasive disposed in the recess;

the bonded abrasive sized and shaped for being profiled, to shape an edge of a glass sheet upon rotation of said tool about the axis;

machining a profile in an outer surface of the bonded abrasive.

23. The method of claim 22 wherein said machining comprises form grinding.

24. The method of claim 22 wherein said machining comprises electro discharge machining.

* * * * *